US009833018B2

(12) United States Patent
Mehio

(10) Patent No.: US 9,833,018 B2
(45) Date of Patent: Dec. 5, 2017

(54) HOOKAH

(71) Applicant: Mya Saray, LLC, Sterling, VA (US)

(72) Inventor: Nizar Youssef Mehio, Tallet El Khayet (LB)

(73) Assignee: Mya Saray, LLC, Sterling, VA (US)

( * ) Notice: Subject to any disclaimer, the term of this patent is extended or adjusted under 35 U.S.C. 154(b) by 417 days.

(21) Appl. No.: 14/621,377

(22) Filed: Feb. 12, 2015

(65) Prior Publication Data

US 2016/0235117 A1 Aug. 18, 2016

(51) Int. Cl.
*A24F 1/30* (2006.01)

(52) U.S. Cl.
CPC ..... *A24F 1/30* (2013.01)

(58) Field of Classification Search
CPC ..... A24F 1/30
See application file for complete search history.

(56) References Cited

U.S. PATENT DOCUMENTS

| | | | | |
|---|---|---|---|---|
| 7,806,123 | B2 * | 10/2010 | Mehio | A24F 1/30 131/173 |
| 8,001,978 | B2 * | 8/2011 | Mehio | A24F 1/30 131/173 |
| 8,573,229 | B2 * | 11/2013 | Mehio | A24F 1/30 131/173 |
| 2009/0095310 | A1 * | 4/2009 | Chaoui | A24F 1/30 131/173 |

* cited by examiner

*Primary Examiner* — Alison L Hindenlang
*Assistant Examiner* — Jamel M Nelson
(74) *Attorney, Agent, or Firm* — Da Vinci's Notebook, LLC

(57) ABSTRACT

The present invention includes a hookah with a stem base bifurcated into two sections. A first section permits attachment to wet smoke outlets for smoke, the second section permits pressure release. A bifurcation wall creates an ideal airflow for purging the stem base.

20 Claims, 5 Drawing Sheets

HOOKAH

FIELD OF THE INVENTION

The present invention relates to the field of hookahs and more specifically to the field of fragile smoking articles.

BACKGROUND

Of the many proud traditions of Ottoman culture, few have achieved the world-wide fame of hookah smoking Once confined to the Middle East and Near East regions, the hookah's notoriety was invigorated by Napoleon's invasion of Egypt and the stream of curious Westerners which followed thereafter. Painters, such as Eugene Delacroix and Jean-Leon Gerome, when depicting Oriental styles typically included a hookah as a symbol of the depicted culture. The hookah was elevated from a regional curiosity to a universal symbol of sophistication.

The hookah, which has maintained a constant popularity in the Middle East, presently enjoys in American culture a unique, niched function. Hookah smoking combines community and relaxation into a single event. Rarely does one witness a group smokers crowded about a single cigarette, cigar, or pipe. Though hookahs are often designed with a single smoke outlet; the presence of multiple hoses, each capable of simultaneous use, emanating from a single smoking instrument is unique to the hookah. Multiple hose hookahs form the centerpieces of hookah clubs in which hookah smokers gather to unwind and converse with other community members. A hookah combines fashion, art, and function into a single device.

A basic hookah includes a bottle, a stem, at least one hose with a mouthpiece, and a bowl. The hookah bowl holds the hookah tobacco, frequently "massell." Massell is a mixture of tobacco, molasses, and often a flavor or fruit extract. The molasses and fruit extract add a substantial amount of moisture to the massell that is missing in conventional tobacco. This added moisture makes massell more sensitive to the elements relative to conventional tobacco; prolonged exposure to air evaporates much of the moisture of massell and reduces its flavor. When properly protected, massell allows a smoker a more recreational, flavored smoke than the tobacco of cigars, cigarettes, pipes, and the like. An experienced hookah smoker will know to loosely distribute massell into a pile within the hookah bowl to allow heat to evenly circulate through the pile.

The heat that ignites the massell derives from coals positioned above the hookah bowl. The coals and massell preferably never contact one to the other. A common method of placing coals proximate to the massell involves spreading a foil upon the top of a hookah bowl, punching holes in the foil, and then placing the coals onto the foil. The heat from the lighted coals travels through the holes in the foil to ignite portions of the massell. Particulates from the massell travel in the smoke created by the ignition down through the hookah bowl into the hookah pipe.

The hookah stem is the body of a hookah and is usually fabricated from brass, tin, or stainless steel. The stem transports the massell smoke from the bowl to the hookah bottle, which is a cavern containing water. The bottle of the hookah is typically fabricated of glass or plastic and tends to be the most expressive portion of the hookah, ranging from translucent to wildly-colored. Within the cavern of the hookah bottle, the massell smoke is cooled by the water within. The cooled massell smoke then returns to the stem, though not through the same entrance by which the massell smoke enters the bottle. From the stem, the massell smoke travels through the hose and out of the mouthpiece.

There are presently two prominent versions of hookah structures: the Lebanese style and the Egyptian style. Although the aficionado will explain that there are many differences between the two styles, the practical layman would quickly note the obvious difference: the connection point between the stem and the hookah bowl. The Egyptian style hookah pipe tapers upward into what is generally referred to as a male connection. The Egyptian style hookah bowl includes a female connection which receives the pipe's male connection. In the Lebanese style hookah the bowl has the tapered male connection and the pipe has the female connection to accept the Lebanese style hookah bowl. In both styles, to allow a more airtight connection a collar is generally added to fit around the male connection.

Those hookahs that happen to utilize pressure release mechanisms with hookahs rely on airflow configurations that fail to emphasize airflow to the pressure release mechanism during positive pressure events. A positive pressure event is an event wherein the air pressure within the hookah increases, and when used in conjunction with a pressure-actuated type seal as disclosed in U.S. Pat. No. 8,001,978 moves the seal mechanism to permit pressure release. In many instances hookahs fail to differentiate in the stem proper between passages for seals and passages for pressure release—and to the extent that there is a distinction, it is usually in a stem attachment or outcropping. Wet smoke suction (for smoking) and wet smoke release are different physical concepts and there is a need for a hookah configuration that treats them accordingly.

SUMMARY

The present invention is directed to hookah that includes a stem and a bottle. The bottle may include any hookah bottle as known in the art that includes a solid sidewall and opening. The hookah stem includes a dry smoke inlet, a wet smoke inlet, a sidewall, one or more wet smoke outlets, and a pressure release outlet. A down tube passes through the stem into the bottle to release dry smoke into liquid contained within the bottle.

The stem of the present invention includes an interior plenum bifurcated by a stem partition wall. The stem partition wall extends from one part of the partition wall to the other in the manner of a chord. The partition wall divides the plenum into a major cavern and a minor cavern. Wet smoke directly rises into the plenum, including into each of the major and minor caverns; however, the major and minor caverns connect to distinct airflow components of the hookah. The major cavern includes a wet smoke outlet dimensioned to accept a hookah hose fitting, and the minor cavern includes a pressure release outlet. It is preferred that the partition wall extends to the depths of the hookah stem, which may include a plunger to further extend the depth of the stem. Furthermore, plates may be used to constrict airflow into the major and minor caverns. The down tube passes centrally through the plenum and through the major cavern into the hookah bottle.

A pressure valve connects with the pressure release outlet for selectively releasing hookah bottle pressure in response to a pulsed pressure surge.

These aspects of the invention are not meant to be exclusive. Furthermore, some features may apply to certain versions of the invention, but not others. Other features, aspects, and advantages of the present invention will be readily apparent to those of ordinary skill in the art when read in conjunction with the following description, and accompanying drawings.

DETAILED DESCRIPTION

Figure 1:
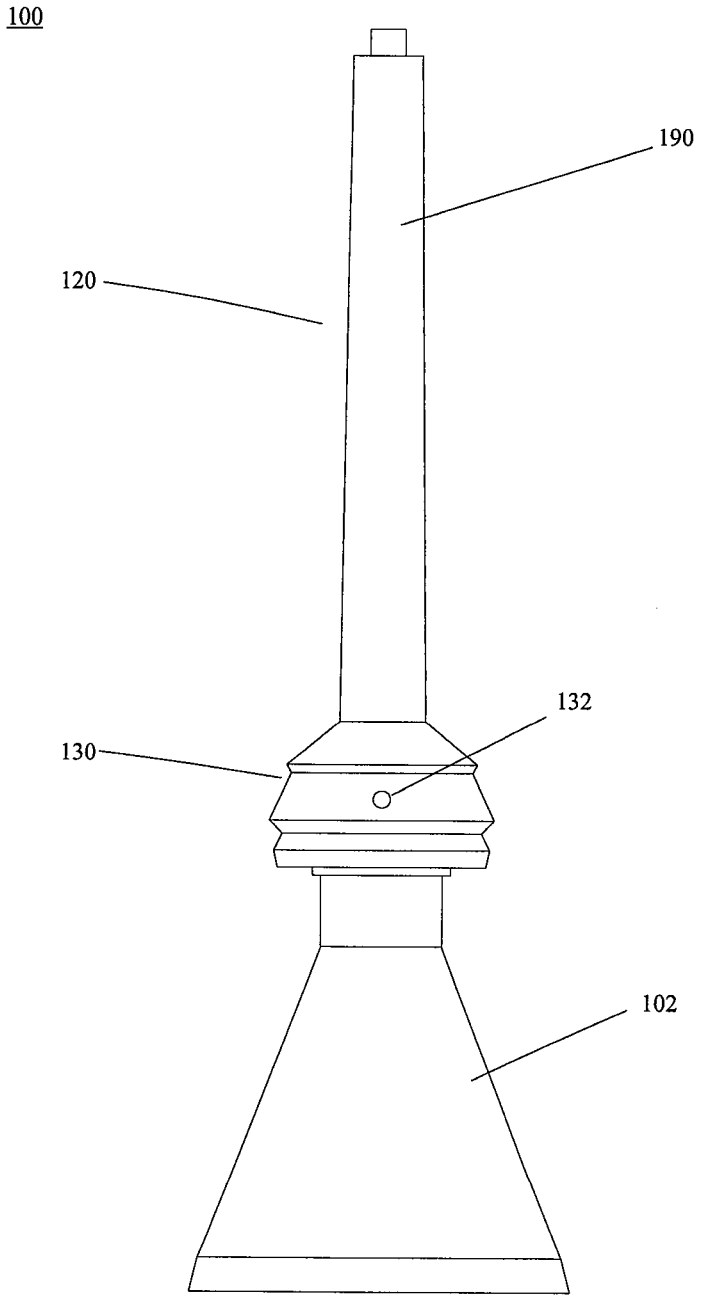
FIG. 1 is a perspective view of the hookah of the present invention.
Figure 2:
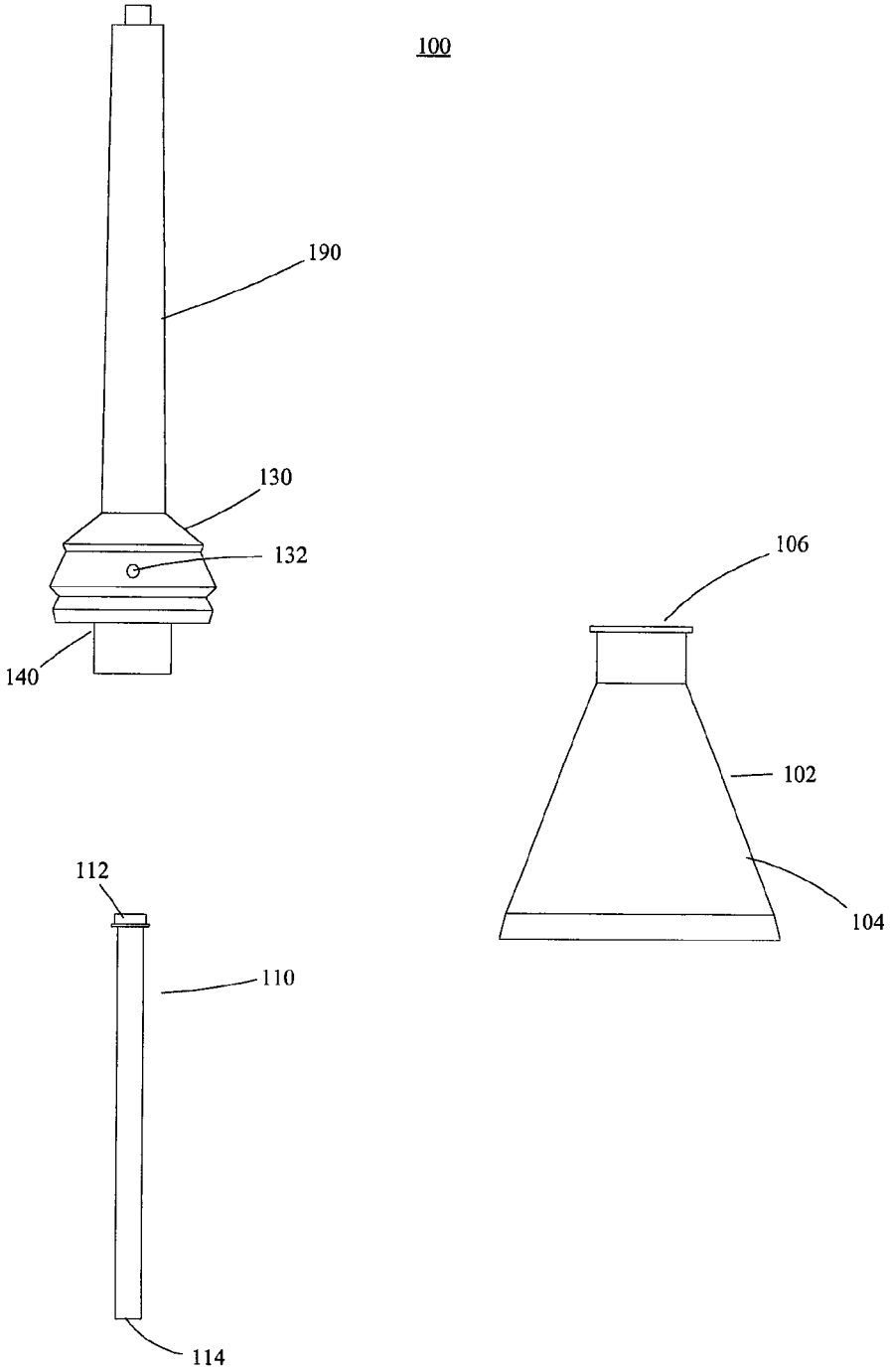
FIG. 2 is a perspective view of the hookah of the present invention.
Figure 3:
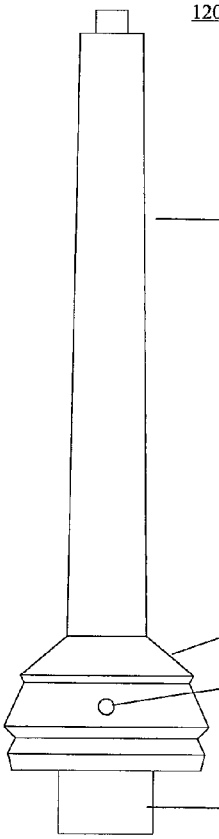
FIG. 3 is a perspective view of the stem of the present invention.
Figure 4:
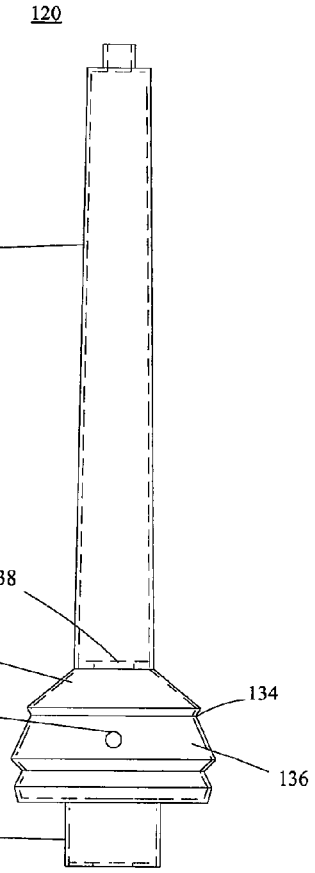
FIG. 4 is a revealed view of the stem of the present invention.
Figure 5:
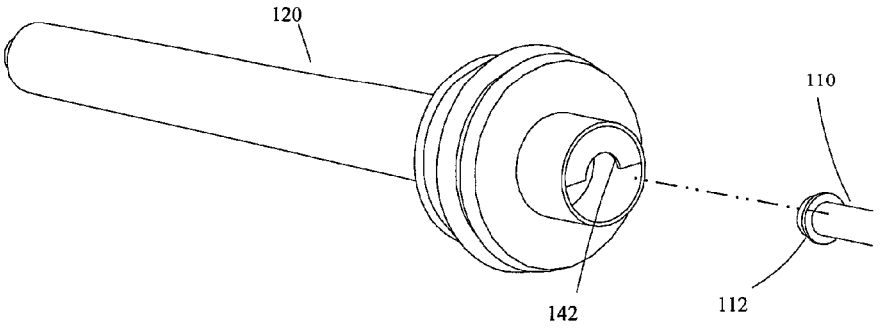
FIG. 5 is a perspective view of the stem of the present invention.

Referring first to FIGS. 1-4, a basic embodiment of the hookah 100 of the present invention is shown. The hookah 100 includes a bottle 102 and stem 120. The stem 120 conceptually includes a dry smoke transport tube 190 and a stem base 130, which may or may not be separable as described in U.S. Pat. No. 7,806,123, the disclosure of which hereby incorporated into the present disclosure. Generally speaking, the dry smoke transport tube 190 is discernable from the stem base 130 by function; the dry smoke transport tube contains only dry smoke that is transported from the burner downward, while the stem base 130 includes complex airflow passages for the shunting of both wet smoke and dry smoke to their respective destinations. The stem base includes wet smoke apertures 132, which as described in U.S. Pat. No. 8,001,978 (the disclosure of which hereby incorporated into the present disclosure), may be for the purpose of drawing smoke to a user or wet smoke pressure release.

The hookah bottle 102 includes a solid sidewall 104 because unlike other smoking instruments, which lack an ornamental nature (particularly derived from the use of delicate materials), the stem contains necessary airflow elements. The hookah bottle 102 has an opening 106 for the stem 120 to send and receive smoke. The stem attaches to the hookah base through any means known in the art, including seal, threading, etc; and may attach at any position known in the art, such as within a hookah bottle neck, outside the hookah bottle neck, or atop the hookah bottle neck.

Dry smoke begins at the burner (not shown) and travels through the dry smoke tube 190. From the dry smoke tube 190, dry smoke enters the stem base where it may or may not be immediately directed to the down tube 110. In any case, the dry smoke enters the stem base 130 through an inlet 138 at the apex thereof. It is preferred in the present invention that the down tube 110 include an attachment means, e.g. threading, pressure-fit, etc., for attaching the down tube to the apex of the stem base or nadir of the dry smoke tube. Placing a down tube at the apex of the base stem permits greater variations in channeling within the base stem with less materials removal therein during fabrication. The dry smoke travels through the down tube to the hookah bottle as it exits the down tube dry smoke outlet 114; and in the preferred invention, the dry smoke is segregated from the base stem by transport through the down tube within the base stem.

When the dry smoke is released from the down tube into the hookah bottle, the liquid cools the smoke. The smoke ascends through the liquid and is released above the surface of the liquid to become wetted smoke. The wetted smoke ascends from the liquid back into the stem base. The present invention utilizes stem plates 142 and/or interior walls (not shown) to selectively alter the airflow within the stem base during periods of positive pressure.

Figure 6:
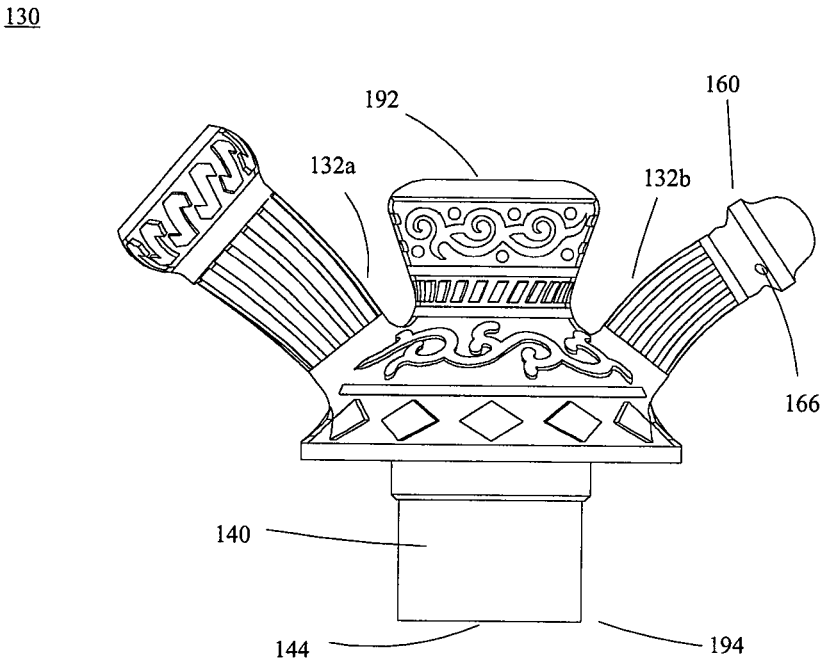
FIG. 6 is a perspective view of the stem base of the present invention.
Figure 7:
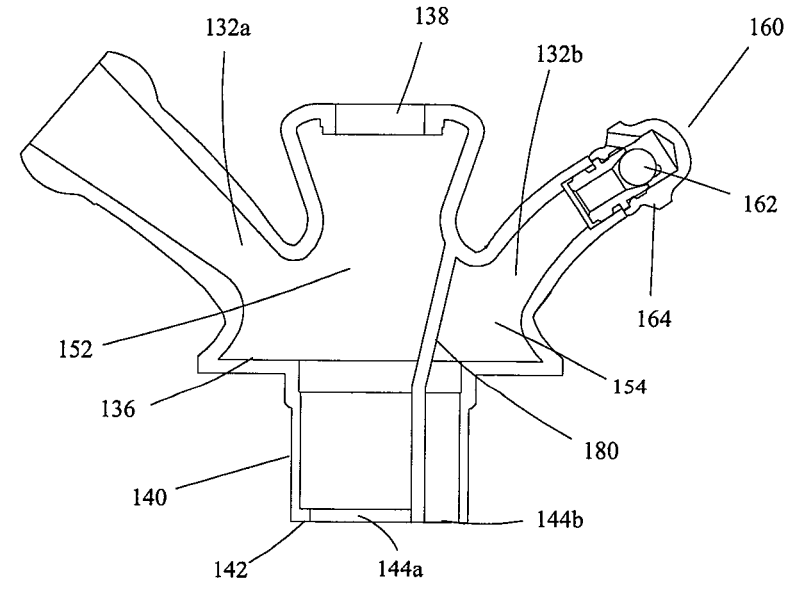
FIG. 7 is a revealed view of the stem base of the present invention.
Figure 8:
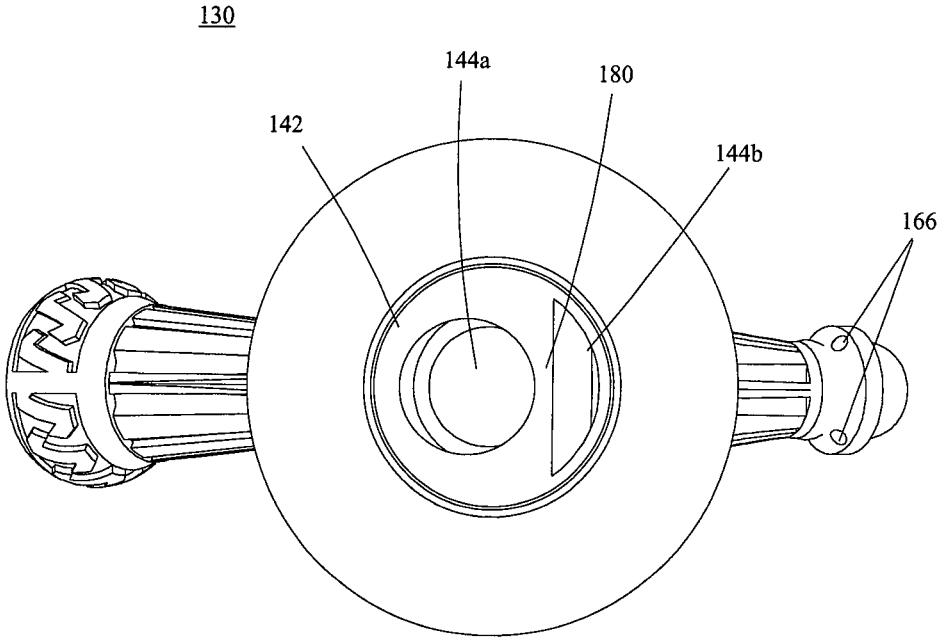
FIG. 8 is a bottom, perspective view of the stem base of the present invention.

Turning now to FIGS. 6-8, one of the recent advances in hookah technology is the use of certain sealing mechanisms to control the pressure within the interior of a hookah. But there are three states of a hookah, negative pressure, equilibrium, and positive pressure. During a state of equilibrium, wetted smoke behaves according to the principles of Brownian motion and will achieve a generally uniform Brownian distribution within the stem base interior. During states of positive pressure (e.g., blowing into the stem base) and negative pressure (e.g., sucking from the stem base), the pressurized wetted smoke behaves according to the principles of Bernoulli and the Continuity Equation. Wherein ρ is fluid density, A is cross section area, v is velocity, and time is time:

$$P(A1)v1(\Delta t)=\rho(A2)v2(\Delta t)$$

Where a hookah includes a pressure release that activates only in positive pressure events, channels leading to the pressure release are a trivial factor in the internal pressure environment of the hookah. However, in instances of positive pressure, the pressure release valve activates to jettison pressure—including as pressure may be able to escape through other smoking hoses. Airflow should have the velocity to both activate the valve and escape in a timely fashion.

The present invention creates an ideal airflow within the base stem that conceptually creates a pipe within a plenum that lacks discrete passages with a cross section area significantly larger than that of the pressure escape vents. In previous hookahs that utilized a shared wet smoke cavern for multiple smoke outlets, pressure lacked any means of constriction except at the point of exit during positive pressure events and required more effort on the part of a user to "purge" the hookah of stale smoke. Stale smoke (also known as "harsh smoke") is smoke that has lingered in the hookah for an excessive amount of time and has an unpleasant taste. By turning the wet smoke cavern portion leading to the pressure release into a structure resembling a staged conduit, the hookah may be purged with less effort and more effectively.

The stem base 130 of the present invention includes a plenum 136 formed by the stem base sidewall 134. The plenum 130 of the present invention includes the portion with the stem base that includes, if one were to axially slice the stem, both wet smoke and dry smoke and the means for transporting the smoke types to their respective destinations. The plenum 136 includes a partition wall 180 that subdivides the plenum into two portions, a major cavern 152 and a minor cavern 154. The major cavern is so-named because it will necessarily be large than the minor cavern in the present invention. Because the down tube 110 will centrally connect to the stem base 130, or otherwise travel centrally through the stem base, the partition wall will form a chord within the plenum. The present invention uses the term chord to indicate a solid body from one portion of the stem sidewall to another portion of the stem sidewall such that does not cross the centerpoint of stem base; to the extent that the plenum is not circular, or near circular (e.g., hexagons), then a chord need only include those aspects of extending from one side to another without crossing through a center point. The partition wall, in its chordical nature as contemplated by the present disclosure, need not be linear or straight.

Wet smoke ascends through the wet smoke inlet 144 at the nadir of the stem base. The preferred partition wall extends to the nadir of the stem base and wet smoke is immediately shunted in the direction of the major cavern or the minor cavern. The purpose of the partition wall is to simulate a lengthy conduit somewhat centrally in a component that lacks non-peripheral conduits. Another of the recent advances in hookah fabrication is the elimination of specific conduits for dry and wet smoke through the use of a strategically placed, removable down tube that features only wet smoke outlets hewn into the sidewall of the stem base—and those outlets generally direct, rather than winding. The present partition wall supplements this advance by permitting the above-mentioned system while also permitting internal conduits to be later fashioned through additive fabrication rather than destructive fabrication.

Although the major cavern may be more sizable than the minor cavern, it is preferred that the major cavern include a major entry 144*a* disproportionately sized in relation to the minor entry 144*b*. The preferred sizing may be further achieved through the use of stem plates 142. A stem plate 142 is a generally flat outcropping from the stem interior into the plenum for the purpose of artificially manipulating airflow. As shown in FIG. 8, the stem plate may include any dimensions for achieving the purposes of the present invention. The preferred stem base uses a stem plate at the wet smoke inlet to constrict the area of the major entry to a minimal size. Although FIG. 8 depicts a major entry larger than the minor entry, it must be remembered that the down tube, which will form a walled barrier, will pass through the major entry. An annular area will be formed for the ascension of wet smoke into the major cavern. It is preferred that the area relationship between the major entry and minor entry be anywhere from 0.25 to 3× without consideration of the down tube. With the addition of the down tube it is preferred that the minor entry be comparable in area to the major entry.

The use of the present invention permits a user to easily purge stale smoke. In a positive pressure event, the smoke within the hookah has a more defined, streamlined flow that avoids the turbulence of one central wet smoke cavern. Airflow begins at the wet smoke outlet 132*a*, travels downward along the down tube out the major entry, returns through the minor entry into the pressure release outlet 132*b*, and into the pressure release valve 160. In pressure release valve, the force of the air pushes against a seal that, upon actuation, opens vents 166 that release wet smoke. The head 164 of the valve 160 may be removable to permit cleaning of the base stem and valve. Alternatively, the removable and interchangeable hose valve and pressure valve components of U.S. Pat. No. 8,573,229 (the disclosure of which is hereby incorporated by reference into the present disclosure) may be used.

The present invention preferably utilizes a plunger 140 on the stem base 130 to submerge a greater portion of the stem toward the liquid of the hookah bottle. The plunger 140 is an extension of the stem base 130 that extends well below the hookah bottle opening. The plunger achieves one of the aspects of the present invention in creating a quasi-conduit out of an open space and lengthening the airflow path from the wet smoke outlet to the pressure valve.

The use of a larger major cavern permits the use of one or more wet smoke outlets, each of which may be connected to a single wet smoke reservoir, here the major cavern. Furthermore, any hookah hose in fluid communication with the major cavern may be used to purge the hookah through the minor cavern with substantially similar airflow patterns. The hookah of the present invention includes at least one wet smoke outlet, for communication of wetted smoke to a hookah hose, and at least one pressure release valve for the selected release of pressure. The pressure release valve of the present invention preferably includes a one-way flow fitting with a stopper (e.g., a ball) disposed within the fitting body or as otherwise described in the '229 patent.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A hookah comprising:

a hookah bottle, having a solid sidewall and a hookah bottle opening, for retaining liquid;

a hookah stem base ("stem"), attachable to said bottle over said bottle opening, having: an apical dry smoke inlet; a nadirical wet smoke inlet; a stem sidewall defining an interior plenum bifurcated by a stem partition wall, chordically extending therethrough, into a major cavern from said stem partition wall to said hookah stem sidewall and a minor cavern from said stem partition wall to said hookah stem sidewall, dimensioned to permit wet smoke from said bottle to directly rise into said plenum; a wet smoke outlet that directly accesses said major cavern and is dimensioned to accept a hookah hose fitting; and a pressure release outlet that directly accesses said minor cavern;

a down tube, extending from said apical dry smoke inlet into said bottle, for passing dry smoke longitudinally and centrally through said major cavern into said hookah bottle; and a pressure valve, in connection with said pressure release outlet, for selectively releasing hookah bottle pressure in response to a pulsed pressure surge.

2. The hookah of claim 1 wherein said stem includes a stem plunger, wherein upon attachment to said bottle said stem plunger extends through and below said bottle opening, and said stem partition extends to said wet smoke inlet.

3. The hookah of claim 2 wherein said stem includes a stem plate extending transversely from said stem wall into said plenum.

4. The hookah of claim 3 wherein said stem plenum includes said stem plate.

5. The hookah of claim 4 wherein said wet smoke outlet and said pressure release outlet are between said stem wet smoke inlet and said stem apical dry smoke inlet.

6. The hookah of claim 3 wherein said stem defines said wet smoke inlet into a major entry, for ascension of wet smoke into said major cavern and passage of said down tube, and a minor entry, for ascension of wet smoke into said minor cavern; and wherein said minor entry and major entry include an area ratio between 0.25-3×.

7. The hookah of claim 6 wherein said minor entry and major entry include an area ratio between 0.5 and 3.

8. The hookah of claim 6 wherein said minor entry area is greater than an ascension area formed between said down tube and said major entry.

9. The hookah of claim 8 wherein said minor entry area is +/−50% said ascension area formed between said down tube and said major entry.

10. The hookah of claim 1 includes a supplemental wet smoke outlet that directly accesses said major cavern and is dimensioned to accept a hookah hose fitting.

11. A hookah comprising:

a hookah bottle, having a solid sidewall and a hookah bottle opening, for retaining liquid;

a hookah stem base ("stem), attachable to said bottle over said bottle opening, having: an apical dry smoke inlet; a stem plunger, wherein upon attachment to said bottle said stem plunger extends through and below said bottle opening forming a nadirical wet smoke inlet; a stem sidewall defining an interior plenum bifurcated by a stem partition wall, chordically extending therethrough, into a major cavern from said stem partition wall to said hookah stem sidewall and a minor cavern from said stem partition wall to said hookah stem sidewall, dimensioned to permit wet smoke from said bottle to directly rise into said plenum; a wet smoke outlet that directly accesses said major cavern and is dimensioned to accept a hookah hose fitting; a pressure release outlet that directly accesses said minor cavern; and a stem plate extending transversely from said stem wall into said plenum;

a down tube, extending from said apical dry smoke inlet into said bottle, for passing dry smoke longitudinally and centrally through said major cavern into said hookah bottle; and a pressure valve, in connection with said pressure release outlet, for selectively releasing hookah bottle pressure in response to a pulsed pressure surge, wherein said stem defines said wet smoke inlet into a major entry, for ascension of wet smoke into said major cavern and passage of said down tube, and a minor entry, for ascension of wet smoke into said minor cavern; and wherein a minor entry area is greater than 50% of an ascension area formed between said down tube and said major entry.

12. A hookah comprising:

a hookah bottle, having a solid sidewall and a hookah bottle opening, for retaining liquid;

a hookah stem base ("stem), attachable to said bottle over said bottle opening, having: an apical dry smoke inlet; a nadirical wet smoke inlet; a stem sidewall defining an interior plenum bifurcated by a stem partition wall, chordically extending therethrough, into a major cavern from said stem partition wall to said hookah stem sidewall and a minor cavern from said stem partition wall to said hookah stem sidewall, dimensioned to permit wet smoke from said bottle to directly rise into said plenum; multiple wet smoke outlets that directly access said major cavern and are dimensioned to accept a hookah hose fitting; and a pressure release outlet that directly accesses said minor cavern;

a down tube, extending from said apical dry smoke inlet into said bottle, for passing dry smoke longitudinally and centrally through said major cavern into said hookah bottle; and a pressure valve, in connection with said pressure release outlet, for selectively releasing hookah bottle pressure in response to a pulsed pressure surge.

13. The hookah of claim 12 wherein said stem includes a stem plunger, wherein upon attachment to said bottle said stem plunger extends through and below said bottle opening, and said stem partition extends to said wet smoke inlet.

14. The hookah of claim 13 wherein said stem includes a stem plate extending transversely from said stem wall into said plenum.

15. The hookah of claim 14 wherein said stem plenum includes said stem plate.

16. The hookah of claim 15 wherein said wet smoke outlet and said pressure release outlet are between said stem wet smoke inlet and said stem apical dry smoke inlet.

17. The hookah of claim 14 wherein said stem defines said wet smoke inlet into a major entry, for ascension of wet smoke into said major cavern and passage of said down tube, and a minor entry, for ascension of wet smoke into said minor cavern; and wherein said minor entry and major entry include an area ratio between 0.25-3×.

18. The hookah of claim 17 wherein said minor entry and major entry include an area ratio between 0.5 and 3.

19. The hookah of claim 17 wherein said minor entry area is greater than an ascension area formed between said down tube and said major entry.

20. The hookah of claim 19 wherein said minor entry area is +/−50% said ascension area formed between said down tube and said major entry.

* * * * *